US009198818B2

(12) United States Patent
Tompkins

(10) Patent No.: US 9,198,818 B2
(45) Date of Patent: Dec. 1, 2015

(54) VIEWING COFFIN

(71) Applicant: Kenard Tompkins, Hockley, TX (US)

(72) Inventor: Kenard Tompkins, Hockley, TX (US)

( * ) Notice: Subject to any disclaimer, the term of this patent is extended or adjusted under 35 U.S.C. 154(b) by 0 days.

(21) Appl. No.: 14/577,412

(22) Filed: Dec. 19, 2014

(65) Prior Publication Data

US 2015/0173990 A1 Jun. 25, 2015

Related U.S. Application Data

(60) Provisional application No. 61/919,242, filed on Dec. 20, 2013.

(51) Int. Cl.
*A61G 17/02* (2006.01)
*A61G 17/04* (2006.01)

(52) U.S. Cl.
CPC ..... *A61G 17/02* (2013.01); *A61G 17/04* (2013.01)

(58) Field of Classification Search
CPC ..... A61G 17/00; A61G 17/02; A61G 17/04; B65D 25/54; B65D 43/163
USPC ..... 27/2, 8, 14, 15; 220/254.9, 345.1, 377
See application file for complete search history.

(56) References Cited

U.S. PATENT DOCUMENTS

| | | | | |
|---|---|---|---|---|
| 204,320 | A | 5/1878 | Hamilton | |
| 454,363 | A | 6/1891 | Kregel | |
| 673,596 | A * | 5/1901 | Dahin | 27/15 |
| RE12,750 | E * | 2/1908 | Hamilton | 27/15 |
| 1,027,453 | A * | 5/1912 | Wible | 27/7 |
| 1,060,654 | A * | 5/1913 | Wise | 27/15 |
| 1,099,436 | A | 6/1914 | Fisher | |
| 1,171,069 | A * | 2/1916 | Schmidt | 27/15 |
| 1,523,973 | A | 1/1925 | Judkins | |
| 1,807,610 | A * | 6/1931 | Williams et al. | 27/8 |
| 4,407,053 | A | 10/1983 | Ball | |
| 4,759,105 | A | 7/1988 | Buerosse | |

FOREIGN PATENT DOCUMENTS

| | | | |
|---|---|---|---|
| CN | 201701430 U | * | 1/2011 |

* cited by examiner

*Primary Examiner* — William Miller
(74) *Attorney, Agent, or Firm* — Daniel Boudwin; Global Intellectual Property Agency LLC

(57) ABSTRACT

A viewing coffin is provided that can support a deceased individual and provide a means of viewing the same without opening the coffin door. The coffin comprises a substantially rectangular structure with an open upper and a coffin door thereover. The coffin door includes an upper portion that comprises a transparent surface. The upper portion is configured to be disposed over the upper body of an individual within the coffin for viewing purposes. The coffin door further comprises a channel disposed within the door and below the upper portion. A slidable lid is provided within the channel that can be operably deployed over the transparent surface to shroud the individual therein. In this way, the lid provides a means to allow viewing of the individual, while the transparent surface separates the body from the ambient environment.

5 Claims, 3 Drawing Sheets

VIEWING COFFIN

CROSS REFERENCE TO RELATED APPLICATION

This application claims the benefit of U.S. Provisional Application No. 61/919,242 filed on Dec. 20, 2013. The above identified patent application is herein incorporated by reference in its entirety to provide continuity of disclosure.

BACKGROUND OF THE INVENTION

1. Field of the Invention

The present invention relates to burial caskets and funeral viewings. More specifically, the present invention relates to a new burial casket that includes a slidable member and a transparent surface through which the individual being buried can be viewed without being exposed to the ambient environment.

Burial coffins and caskets are commonly used to support the remains of deceased individuals and provide a vessel within which the deceased can be respectfully supported prior to and after burial. Burial coffins vary in complexity, in features, and in ornamentation. Some of elements provide improved functions for loading the deceased, while others improve viewing ceremonies in which the deceased is viewed prior to burial. Most coffins include an elongated, rectangular structure with one or more coffin lids over an open upper. The lids can be opened during viewings and can be closed and sealed prior to burial.

Grieving family members and loved ones paying respects often wish to view the deceased one final time prior to burial. Traditionally a viewing ceremony is held, in which the deceased individual is placed within the coffin and the lid is opened such that he or she is visible for final respects. For some, displaying the deceased in an open environment is not preferred, as the body may not be completely sanitized and the fear of contracting contagions is enough to forego the viewing ceremony.

The present invention offers a solution to this problem in the art of coffin designs. The present invention provides a coffin with transparent cover disposed over the opening of the coffin, whereby the deceased is viewable when the coffin lid is open, but the body is not open to the environment. The transparent cover is secured to the walls of the coffin and is coextensive with the coffin opening with the coffin lid is in an open position. The coffin lid is a sliding member that is disposed within the interior of the coffin door, whereby the coffin door can be closed and the transparent cover secures the body in the coffin when the lid is in an open or a closed state. This seals the body from the ambient environment, while still permitting others to view the body when the body is therein.

2. Description of the Prior Art

Devices have been disclosed in the prior art that relate to coffins and caskets. These include devices that have been patented and published in patent application publications. These devices generally relate to various means of covering the body in a coffin, including those that contemplate transparencies. The following is a list of devices deemed most relevant to the present disclosure, which are herein described for the purposes of highlighting and differentiating the unique aspects of the present invention, and further highlighting the drawbacks existing in the prior art.

One such device in the prior art is U.S. Pat. No. 204,320 to Hamilton, which discloses a burial casket with a movable lid that extends substantially along the entire length of the casket and provides an opening within which to position the individual to be buried. The lid slides within parallel grooves and can be removed entirely from the casket, and then positioned over the casket opening. While Hamilton contemplates a slidable cover, the cover does not expose a transparent surface covering the individual therein for viewing purposes. The cover of Hamilton extends the length of the casket and exposes the individual when removed. The present invention contemplates a slidable cover that slides within the door of the casket, whereby the cover is slidable over a transparent surface built into the door of the casket.

Another device is U.S. Pat. No. 1,523,973 to Judkins, which discloses a burial coffin having a transparent window and a cover. The transparent surface is shrouded by the cover prior to burial, whereby the cover is fastened using screws through the cover and into the coffin. Sets of screws secure the coffin door to the coffin, and the cover to the coffin door. As with Hamilton, the Judkins device fails to contemplate the configuration of the present invention, which comprises a slidable cover that enters the interior of the coffin door and covers a transparent surface when deployed from the door and over the transparent surface.

U.S. Pat. No. 1,099,436 to Fisher discloses a burial coffin with a disappearing panel that moves along tracks and can be used to inspect the coffin without removing the door. The disappearing panel runs along tracks below the door and can be moved inward and along the door to expose a portion of the coffin interior. Unlike Fisher, the present invention utilizes a coffin door with a channel therein, whereby a slidable cover is disposed over a transparent surface and the cover slides parallel to the coffin door to expose the individual in the coffin, and to shroud the same prior to burial.

U.S. Pat. No. 4,407,053 to Ball discloses a transparent cover for a casket that is configured to secure to the walls of the casket about the head of the individual therein, and be supported below the removable casket lid. The transparent cover comprises a domed, convex shape that includes a periphery margin that is affixed to the casket. The domed feature improves visibility, while the shape is confined to the interior of the casket when the casket lid is closed. The Ball device, however, fails to provide a new casket construction in which a transparent window is shrouded and revealed by a movable panel or cover that slides from a channel within the coffin door.

Finally, U.S. Pat. No. 4,759,105 to Buerosse discloses a body case for shipping remains from one country to another, whereby one embodiment contemplates a transparent cover for viewing purposes prior to cremation. The material of the transparent cover melts when the body case is placed within a crematorium. The body case is used to contain a body within a coffin, during transport, and when placed within a crematorium. Therefore bodies having contagions are encased therein and diseases are prevented from spreading, and the body does not have to be removed from the case prior to cremation. The Buerosse fulfills a specific need in the art; the present coffin is not one that contemplates a transparent surface extending the length of the coffin, or one that is particularly suited for encapsulating a body in an air tight manner prior to cremation. The present invention is a casket that can be buried, placed within a mausoleum, or alternatively placed within a crematorium if so designed. The transparent window of the present invention is partially extending along the coffin door, whereby the window is covered by a sliding cover.

The present invention provides a new and improved viewing coffin that allows a deceased individual to be viewed without being exposed to the ambient environment. Specifically, the coffin comprises an open upper with a door that is positionable thereover. The door includes an upper portion that is configured to be disposed above the upper body of a body therein. The upper portion comprises a transparent surface that is coextensive and secured to an opening through the door. A slidable lid is disposed within a channel along the interior of the coffin door, whereby the lid can be moved into a position over the transparent cover to operably shroud the body or allowing viewing thereof.

It is submitted that the present invention diverges in design elements from the prior art, and consequently it is clear that there is a need in the art for an improvement to existing viewing coffin devices. In this regard the instant invention substantially fulfills these needs.

SUMMARY OF THE INVENTION

In view of the foregoing disadvantages inherent in the known types of burial coffins now present in the prior art, the present invention provides a new and improved viewing coffin in which can be utilized for providing convenience for the user during a viewing, whereby the deceased user's body can be viewed without being otherwise exposed to the environment while the coffin door is in a closed state.

It is therefore an object of the present invention to provide a new and improved viewing coffin that has all of the advantages of the prior art and none of the disadvantages.

It is another object of the present invention to provide a viewing coffin that can be used to view a deceased individual without opening the coffin door and without otherwise exposing the body to the ambient environment.

Another object of the present invention is to provide a viewing coffin with a coffin door having an upper portion that comprises a transparent surface, whereby the deceased can be viewed through the transparent surface without opening the coffin door.

Yet another object of the present invention is to provide a viewing coffin having a slidable lid that is positionable over the transparent surface, whereby the deceased can be operably viewed or shrouded from view.

Another object of the present invention is to provide a viewing coffin that supports the slidable lid within a channel in the coffin door, whereby the lid is manually operated and can be slid to completely expose the transparent surface, or alternatively cover the transparent surface from view.

Another object of the present invention is to provide a viewing coffin with a coffin that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
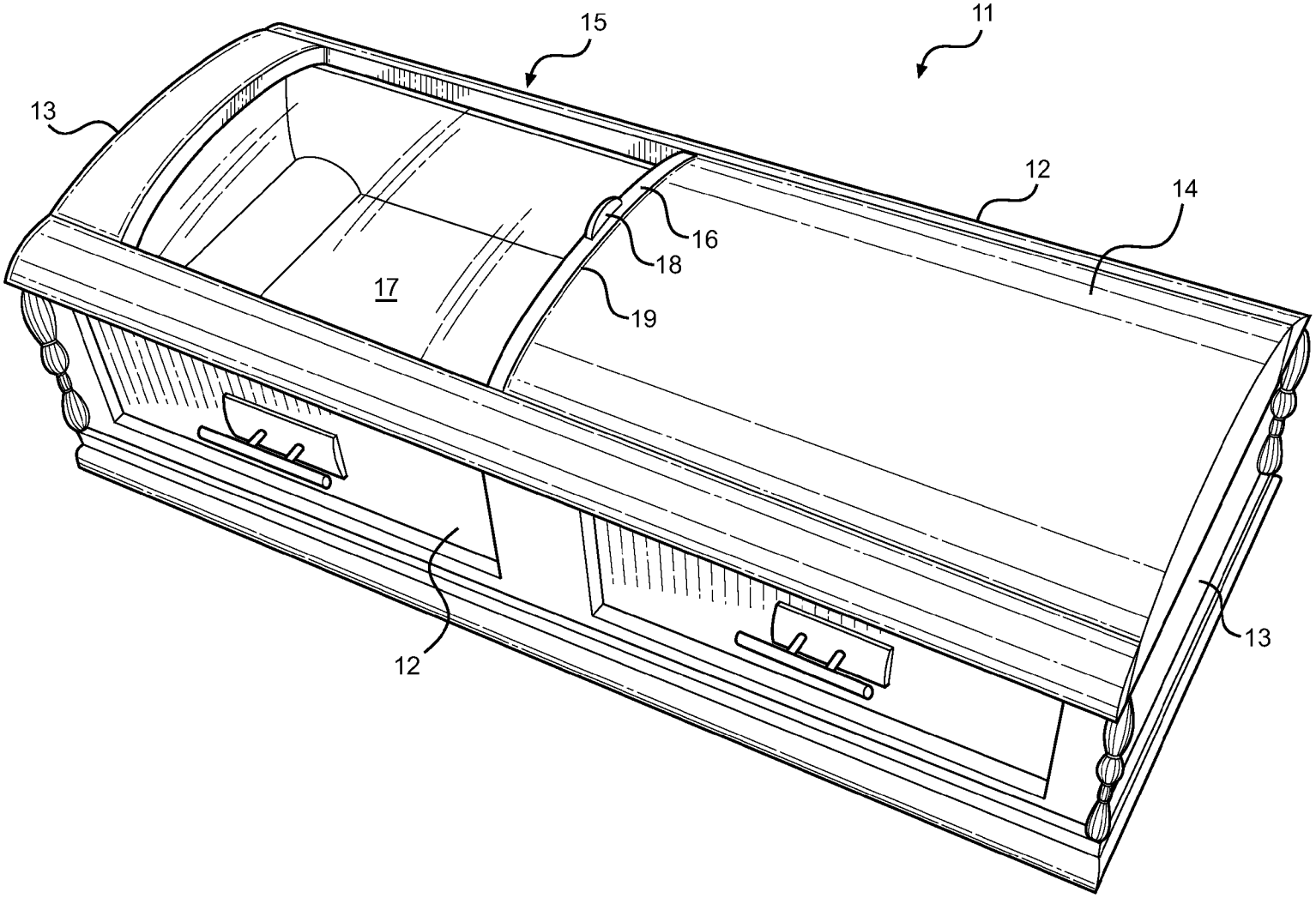
FIG. 1 shows an overhead perspective view of the viewing coffin of the present invention, whereby the coffin lid is in a stowed state within the coffin door and the upper interior portion of the coffin is visible through the transparent surface.

Reference is made herein to the attached drawings. Like reference numerals are used throughout the drawings to depict like or similar elements of the viewing coffin of the present invention. For the purposes of presenting a brief and clear description of the present invention, the preferred embodiment will be discussed as used for supporting a deceased individual therein and allowing operable viewing thereof without opening the coffin door and without otherwise exposing the individual to the ambient environment. The figures are intended for representative purposes only and should not be considered to be limiting in any respect.

Referring now to FIG. 1, there is shown a perspective view of the viewing coffin of the present invention. The coffin 11 comprises an elongated, substantially rectangular coffin box common of burial coffins and caskets in the art. The coffin 11 comprises a pair of sidewalls 12, end walls 13, a lower surface, and an open upper surface forming an open coffin for support of deceased individuals therein. The exterior may comprise handles and various types of ornamentation, while the shape of the coffin and the contours of its inner and outer surfaces may vary depending upon sophistication level of the ornamentation and the preferences of the purchaser.

Covering the open upper of the coffin is an elongated coffin door 14, is coextensive with the open upper and is hinged to one sidewall 12. The coffin door 14 hinges between an open and a closed state, whereby the body of the deceased can be secured within the coffin interior when the door 14 is closed. Along the upper portion 15 of the door 14 is a transparent surface 17, which is supported by the door 14 and provides a means to view the body lying within the coffin within the door 14 in a closed state.

The transparent surface 17 comprises a set of perimeter edges that are supported by the door within the upper portion 15, whereby the upper portion 15 provides a recessed cutout for the transparent section to be supported or attached thereto along its edges. The transparent surface 17 may further comprise a flat or curved surface, and may comprise a glass or more resilient polymer construction. The upper portion 15 comprises a lower edge, a pair of side edges, and an upper edge. The upper and lower edges are substantially parallel and the lower edge is disposed along the midportion of the door. The upper edge is disposed along an end of the door such that the upper portion displays the upper body of the deceased in the coffin box.

Slidable over the transparent surface 17 is a slidable lid 16, which is extendable from within a channel within the coffin door 14. The lid 16 extends through an opening 19 along the upper end of the channel such that the lid 16 can slide from a stowed position within the channel to an extended position over the transparent surface 17. The lid 16 includes an upstanding handle 18 or similarly handle grip such that a user can move the lid 16 between the stowed and deployed states.

Figure 2:
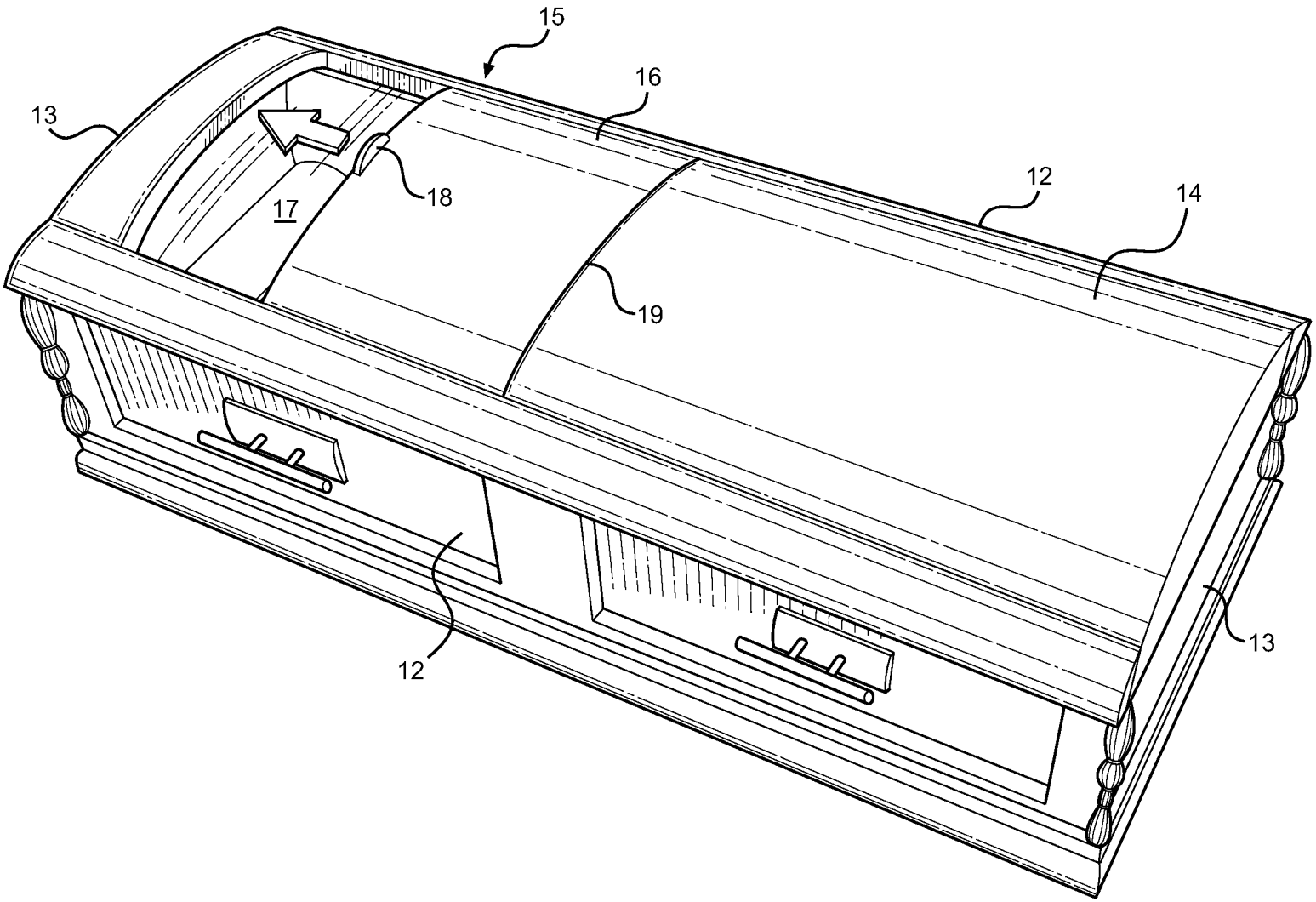
FIG. 2 shows a view of the slidable lid to be moved into a closed state over the transparent surface.

FIG. 2 provides a view of the lid 16 being moved into a deployed state over the transparent surface 17. Once the lid 16 is in a fully extended position, the transparent surface 17 is full covered and the interior of the coffin is shrouded. The lid 16 therefore performs dual functions, it shrouds the transparent surface 17, and it provides a cover thereover to protect the same. The lid 16 may be supported along its sides within individual channels, whereby the lid 16 overlaps the door 14 when fully extended along the channel opening 19 and along its side edges. The upper edge may further engage the uppermost section of the door 14 for a final overlap portion, thereby supporting the door along its edges when weight is applied thereto.

Figure 3:
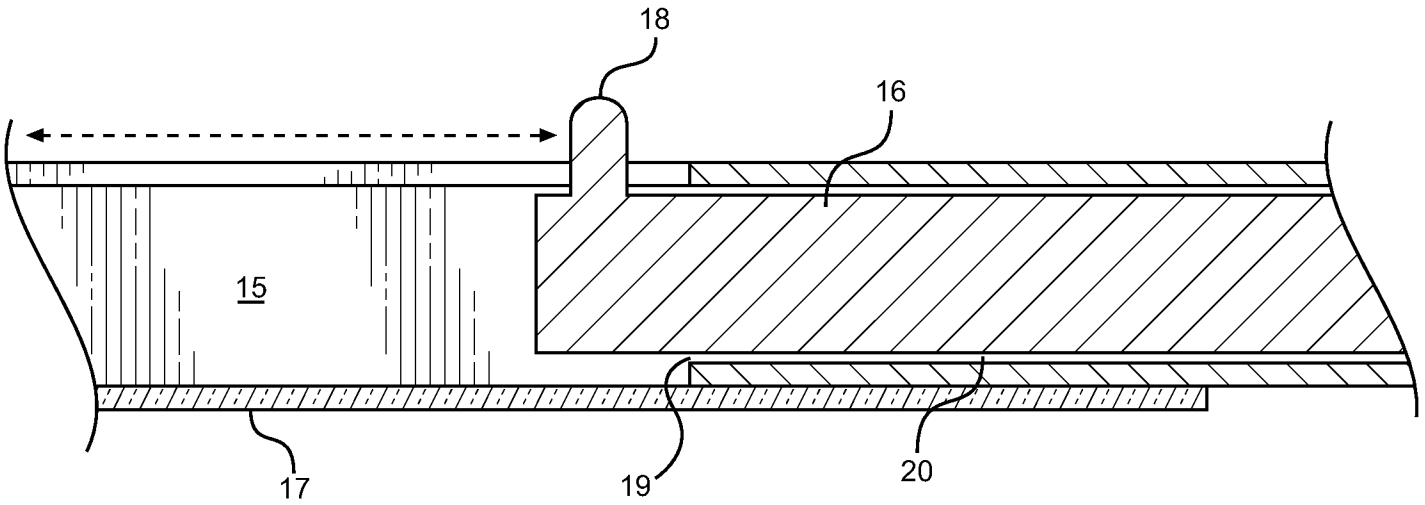
FIG. 3 shows a cross section view of the coffin door, channel, and slidable lid at the lower end of the coffin upper portion.

Referring now to FIG. 3, there is shown a cross sectional side view of the sliding lid 16 disposed within the channel 20 of the coffin door. The sliding lid 16 is slidably received through an opening 19 and through the interior of the channel 20, whereby the lid 16 may be entered thereinto or withdrawn therefrom. When withdrawn, the user grips the handle grip 18 and slides the lid 16 from the channel 20 into the exposed upper portion 15 above the transparent surface 17. When slid from the channel 20, the lid 16 is coextensive with the transparent surface 17 and shrouds it from view along the exterior of the coffin. In this manner, the lid provides an operable viewing window through which to visualize the deceased within the coffin.

When an individual passes away, family members or friends pick out coffins for the body to be buried in. Coffins are generally constructed in a way that conceals the individual inside the coffin, unless the coffin door is opened. Opening and closing a coffin door can be a struggle and can also prevent individuals from getting a last look at the deceased individual. Current coffins do not provide users with accessible and instant means to view the deceased individuals as may be desired when the door is in a closed state. Therefore, the present invention is disclosed for operably providing a viewing window through the door, whereby a transparent surface along the door provides visualization of the deceased. The lid secures over the transparent surface when closing the casket interior from view and during burial It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A viewing coffin, comprising:

an elongated and substantially rectangular coffin box;

said coffin box having end walls, sidewalls, a lower surface, an open interior, and an open upper surface;

a coffin door coextensive with said open upper surface of said coffin box;

said coffin door having an upper portion comprising a transparent surface to view said open interior from outside of said coffin box;

said upper portion having a lower ledge, side edges, and an upper edge;

said coffin door having a channel within an interior of said coffin door;

said channel having an opening along said lower edge of said upper portion;

a lid slidably deployable from said channel;

said lid coextensive with said transparent surface and positioned thereover when slidably deployed from said channel.

2. The viewing coffin of claim 1, wherein said lid further comprises a handle grip.

3. The viewing coffin of claim 1, wherein:

said lower edge of said upper portion is disposed along a midportion of said coffin door, said upper edge of said upper portion disposed adjacent to an end of said coffin door;

said upper edge of said upper portion and said lower edge are substantially parallel;

said side edges of said upper portion are substantially parallel to one another.

4. The viewing coffin of claim 1, wherein said transparent surface is substantially planar.

5. The viewing coffin of claim 1, wherein said transparent surface is substantially curved.

* * * * *